United States Patent [19]

Fink

[11] Patent Number: 5,072,778

[45] Date of Patent: Dec. 17, 1991

[54] CASTING VESSEL FOR HOT-CHAMBER PRESSURE DIECASTING MACHINES

[75] Inventor: Roland Fink, Winterbach, Fed. Rep. of Germany

[73] Assignee: Oskar Frech GmbH & Co., Fed. Rep. of Germany

[21] Appl. No.: 526,588

[22] Filed: May 22, 1990

[30] Foreign Application Priority Data

May 30, 1989 [DE] Fed. Rep. of Germany ..... 3917487

[51] Int. Cl.[5] ..... B22D 17/04

[52] U.S. Cl. ..... 164/316; 164/309

[58] Field of Search ..... 164/113, 316, 317, 318, 164/309, 310, 311

[56] References Cited

U.S. PATENT DOCUMENTS 4,091,970 5/1978 Komiyama et al. ..... 164/316

4,556,098 12/1985 Hintermann et al. ..... 164/316

*Primary Examiner*—Kuang Y. Lin

*Attorney, Agent, or Firm*—Evenson, Wands, Edwards, Lenahan & McKeown

[57] ABSTRACT

A highly stressed casting vessel for hot-chamber pressure diecasting machine is provided with a cast-in, correspondingly bent pipe as the ascending bore which is welded together from three parts, in which case two different elbow parts which are connected with a straight pipe piece may each individually be adapted to the locally occurring requirements. Thus, the high-expenditure finishing and pressure losses of the flowing molten baths associated with inserted cores used in producing the ascending bore are avoided.

21 Claims, 2 Drawing Sheets

CASTING VESSEL FOR HOT-CHAMBER PRESSURE DIECASTING MACHINES

BACKGROUND AND SUMMARY OF THE INVENTION

The present invention relates to a casting vessel for hotchamber pressure diecasting machines, which vessel is cast in one piece from heat-resistant tool steel, and, more particularly, to a casting vessel which comprises a casting chamber with running surfaces for a casting plunger, and an ascending bore arranged approximately in parallel to the casting chamber so as to lead into the casting chamber at one end and equipped at the other end with a mouthpiece for connecting a nozzle.

In a known casting vessel of the type shown in DE-AS 21 43 937, the ascending bore is cast in with inserted cores. For this purpose, the ascending bore extends axially out of the casting vessel at one end and is closed by a screw applied there. The connection to the casting chamber takes place by way of a duct extending perpendicularly to the casting chamber which was also formed by an inserted core and must also be closed off to the outside by a screw. The machining of the ascending bore and as well as of the transverse duct therefore requires relatively high expenditures. This also applies to the connecting cone for the nozzle provided in the area of the mouthpiece. As a result of the rectangular transition from the connecting duct to the ascending bore and of the approximately rectangular transition provided also in the area of the mouthpiece, pressure losses occur for the flowing molten bath which may have a disadvantageous effect on the working speed.

It is an object of the present invention to provide such a casting vessel in which pressure losses are avoided and no high expenditure machining operations are required.

The foregoing object has been achieved in accordance with the present invention by providing a cast-in pipe as an ascending bore in such a casting vessel. This pipe is bent in the area of the mouth leading to the casting chamber and in the area of the mouthpiece and is welded together from at least two parts. As a result, it is now possible to cause the transition into the parallel part of the ascending pipe by means of a fluidically advantageous deflection. As a result of the welded construction of the pipe, it is also now possible to vary the geometry of the pipe and to adapt the pipe in each particular case to the loads to be expected for the deflection of the molten bath as well as to the stresses to be expected as a result of the occurring temperatures.

According to another advantageous feature of the present invention, the ascending pipe comprises a first elbow in the area of the mouth leading to the casting chamber, an essentially straight pipe piece which connects to this first elbow and a second elbow in the area of the mouthpiece which connects to the pipe piece. As a result of this construction, both elbows may be individually adapted to the respective requirements without the necessity of taking into account the dimensions of the straight pipe piece disposed between them.

The second elbow may advantageously also consist of a piece having a receiving cone for the nozzle so that there will not be any problems with respect to intersecting points. The wall thickness of the receiving cone may increase in the direction of the opening so that the wall thickness meets the demands of the occurring stress at the critical point. Furthermore, the inside diameters of the elbows can be changed and reduced in the flowing direction of the molten bath so that an adaptation to the specific fluidic requirements becomes possible. It is also possible to vary the bending radii and to construct the wall thicknesses of the elbow parts to differ and to adapt them to the respective existing conditions.

BRIEF DESCRIPTION OF THE DRAWINGS

These and further objects, features and advantages of the present invention will become more apparent from the following detailed description of a presently preferred embodiment when taken in conjunction with the accompanying drawings wherein.

DETAILED DESCRIPTION OF THE DRAWINGS

Figure 1:
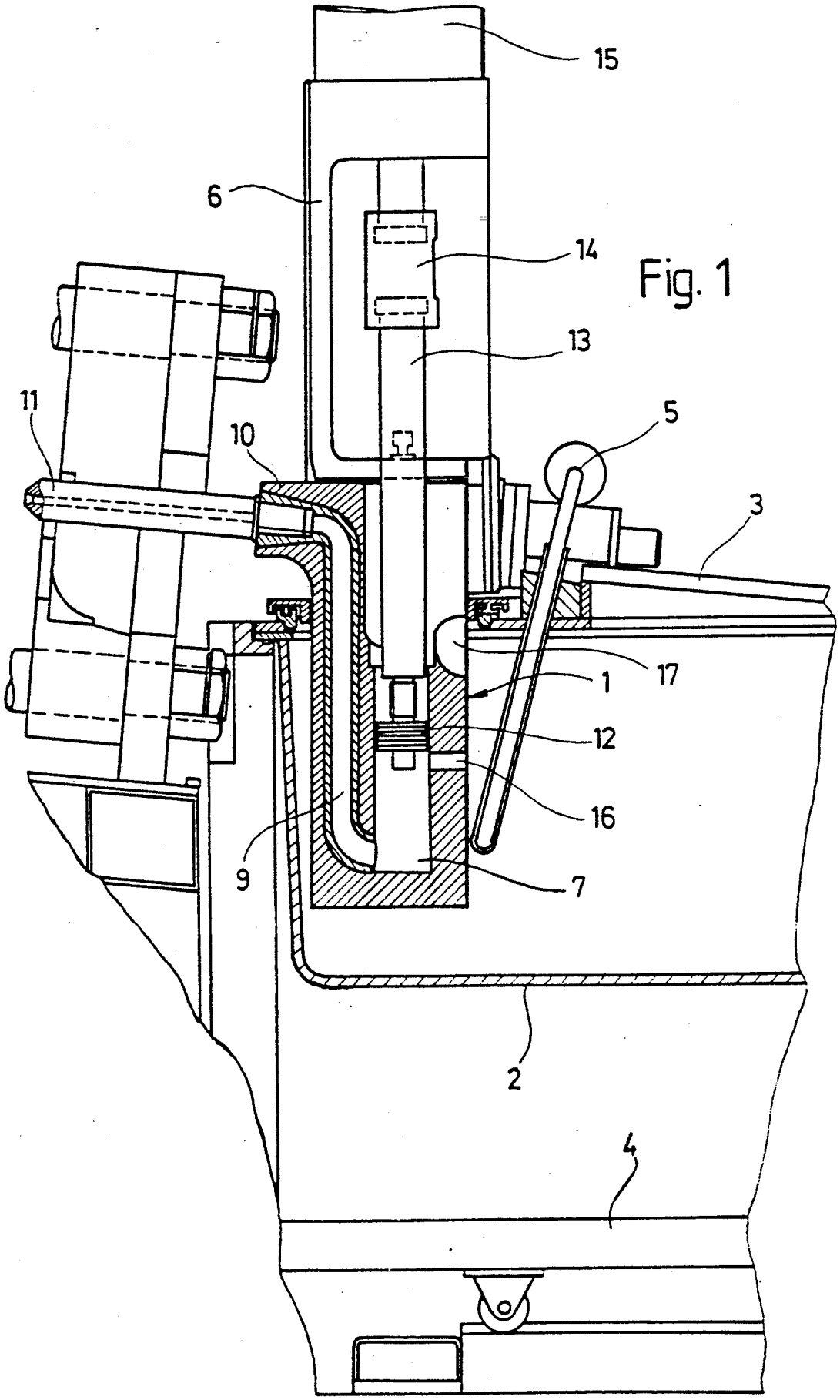
FIG. 1 is a schematic sectional view of a hot-chamber pressure diecasting machine equipped with a casting vessel according to the present invention.

A hot-chamber pressure diecasting machine is shown in FIG. 1 and comprises a casting vessel designated generally by the numeral 1 which is inserted from above into a tundish or tub 2 in which a molten bath is located. The metal to be melted is fed into the tub 2 by way of an opening closed by a flap 3. The tub 2 is arranged in a furnace 4 so that the fed metal particles can be melted in it. A thermometer 5 dips into the tub 2 for monitoring the temperature existing in the area of the casting vessel 1.

The casting vessel 1, which is held by a crosshead 6, comprises a casting chamber 7 and an ascending bore 9 connected with it which leads to a mouthpiece 10 at which an inclined nozzle 11 is arranged. In this embodiment, the casting chamber 7 consists of a sleeve-shaped part which is inserted into the casting vessel 1 as shown in FIG. 2.

A casting plunger 12 is guided in the casting chamber 7 which is connected with a hydraulic cylinder 15 by way of a plunger rod 13 and a coupling 14. In FIG. 1, the casting plunger 12 is in its upper dead center position. Below this dead center position, several bores 16 are provided in the casting vessel 1 and are uniformly distributed over the circumference thereof to connect the casting chamber 7 with the tub 2 so that the molten bath flows into the casting chamber 7. The molten bath is then pressed out of the casting chamber 7 by way of the ascending bore 9 with the nozzle 11 by the lowering of the casting plunger 12. As a result of the oblique arrangement of the nozzle 11, the molten bath can flow back into the area of the ascending bore 9 from the nozzle 11 when the casting plunger 12 is withdrawn, so that the molten bath remains inside the heated area and does not solidify. The inside diameter of the casting vessel 1 which is open toward the top expands above the casting chamber 7. By way of openings 17, this area is also connected to the tundish or tub 2 so that the casting plunger is surrounded by the molten bath also on its top side.

Figure 2:
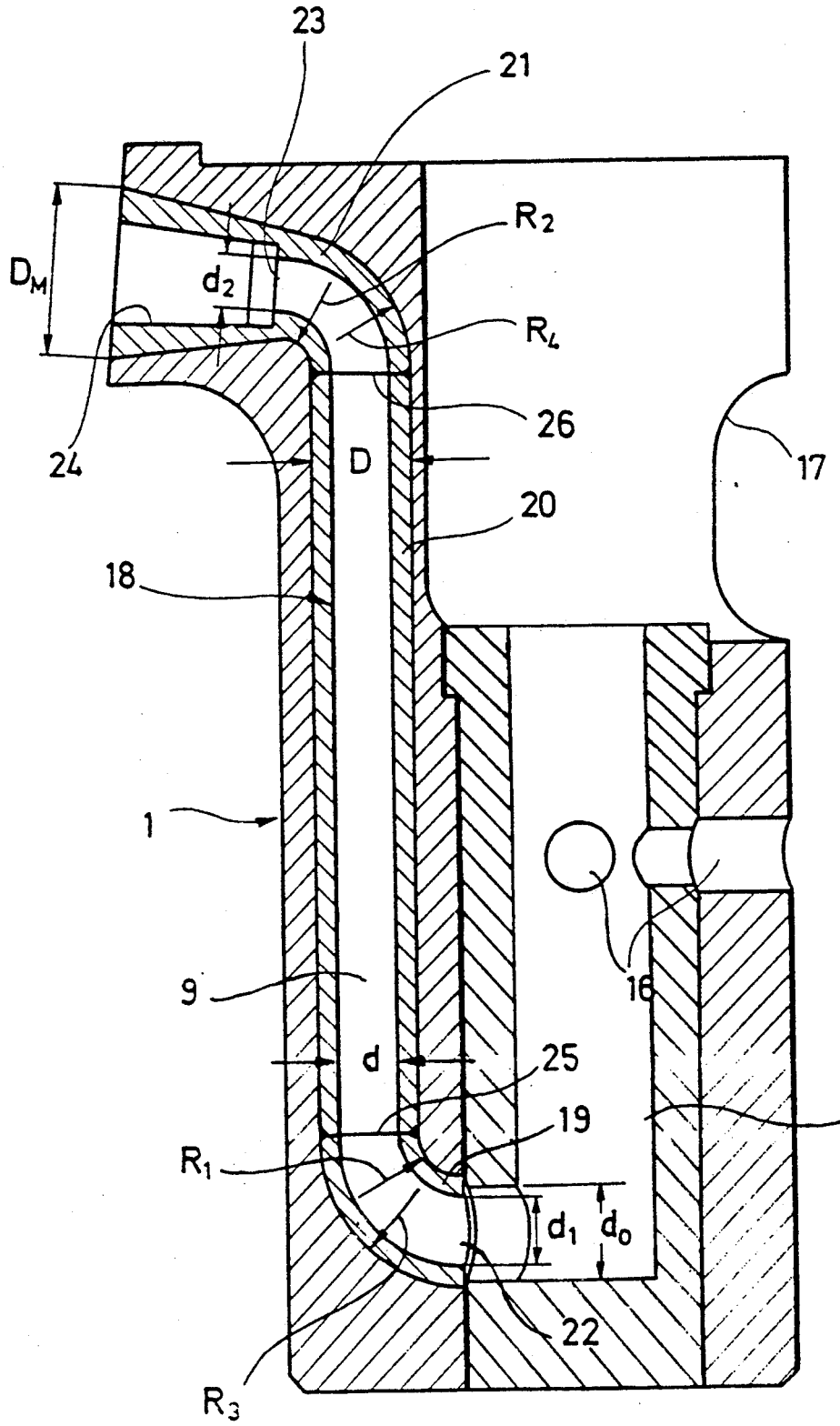
FIG. 2 is an enlarged sectional view of the casting vessel of the hot-chamber pressure diecasting machine shown in FIG. 1.

The casting vessel 1 shown in FIG. 2 is manufactured as a cast part from a heat-resistant tool steel alloy. Cast casting vessels have economical advantages in comparison to forged constructions. The high-value, hot-work steel types which are required in modern hot-chamber pressure diecasting machines because of the higher casting pressures (up to 400 bar) can also be forged.

As shown in FIG. 2, the casting vessel 1 is provided with an ascending bore 9 which consists of a pipe 18 which is also cast in and which is welded together from three parts. The pipe 18 comprises an elbow 19 connecting to the casting chamber 7, a cylindrical pipe piece 20 which borders the elbow, and a second elbow 21 which borders on the pipe piece 20 in the area of the mouthpiece 10. The inside diameter of the first elbow 19 diminishes from the mouth 22 at the casting chamber 7 to the connection to the pipe piece 20; i.e., at the connecting point 25 to the pipe piece 20, the inside diameter of the elbow 19 corresponds to the inside diameter (d) of the pipe piece 20, but has a larger diameter ($d_1$) at the mouth 22. The mouth 22 is disposed opposite an opening in the casting chamber 7 which has a diameter ($d_0$) which is larger than ($d_1$). The second elbow 21, at its connecting point 26 to the pipe piece 20, also has the inside diameter (d), but in the area of its mouth 23 leading into a receiving cone 24, has the diameter ($d_2$) which is smaller than the diameter (d). In an actual embodiment, for example, diameter $d_1$ may be 16 mm; diameter d may be 14 mm; and diameter $d_2$ may be 12 mm. The transition of the inside diameters of the elbows 19, 21 from the larger inside diameter to the smaller inside diameter takes place continuously.

As indicated above, the elbow 21 is provided with a onepiece receiving cone 24 for the nozzle 11. In the area of the receiving cone 24, the cone angle of which may amount to approximately 5°, the nozzle 11 has a wall thickness which increases toward the outside, the outer wall of the receiving cone 24 changing into the outer wall of the elbow part 21 at a larger cone angle, i.e., approximately 10°, than the receiving cone 24 itself. In the illustrated embodiment, the second elbow 21, at the connecting point to the pipe piece 20, therefore has an outside diameter (D) which corresponds to the outside diameter (D) of the pipe piece 20, while it has a diameter ($D_M$) at the mouth which is significantly larger. In a preferred embodiment, the diameter D may be 24 mm and the diameter $D_M$ may be 40 mm.

The bending radii of the elbows 19, 21 also vary. Thus, the first elbow 19 has an inside radius ($R_1$) which is larger than the inside radius ($R_2$) of the second elbow 21. The outside bending radius ($R_3$) of the first elbow 19 is also larger than the outside bending radius ($R_4$) of the second elbow 21. In the illustrated embodiment, for example, the inside radius $R_1=9$ mm; the inside radius ($R_2$) of the second elbow 21 is 7 mm; the outside radius of the first elbow $R_3=35$ mm; and the outside radius of the second elbow $R_4=31$ mm.

The first elbow 19, which is welded to the pipe piece 20 at point 25, is thus adapted to the requirements of the flow of the molten bath which occurs at this point. The 90°-transition takes place without any sharp corners so that pressure losses or swirls cannot occur in the molten bath pressed out of the casting chamber 7. The second elbow 21, which at point 26 is welded to the pipe piece 20, also is individually adapted to the existing conditions. The inside diameter of the second elbow 21, as well as the inside diameter of the first elbow 19, diminish in the flow direction. In addition, the second elbow 21 is provided with the one-piece receiving cone 24 so that also at this point, no difficulties occur at the connecting point for the nozzle 11. Finally, the wall thicknesses, particularly of the second elbow 21, in the area of the receiving cone 24, are selected such that they withstand the required stresses without the necessity of high-expenditure finishing operations at the completed casting vessel.

Although the invention has been described and illustrated in detail, it is to be clearly understood that the same is by way of illustration and example, and is not to be taken by way of limitation. The spirit and scope of the present invention are to be limited only by the terms of the appended claims.

I claim:

1. A casting vessel for hot-chamber pressure diecasting machines which is cast in one piece from heat-resistant tool steel, comprises a casting chamber with running surfaces for a casting plunger, an ascending bore arranged approximately in parallel to the casting chamber so as to lead into the casting chamber at one end and have a mouthpiece at the opposite end for connecting a nozzle, wherein the ascending bore is a cast-in pipe bent in the area of a mouth leading to the casting chamber and in the area of the mouthpiece and welded together from at least two components.

2. The casting vessel according to claim 1, wherein the pipe comprises a first elbow in the area of the mouth leading to the casting chamber, an essentially straight pipe piece connecting to the first elbow, and a second elbow in the area of the mouthpiece connecting to the pipe piece.

3. The casting vessel according to claim 2, wherein the second elbow comprises a piece with a receiving cone for the nozzle.

4. The casting vessel according to claim 3, wherein the wall thickness of the receiving cone increases toward a mouth of the nozzle.

5. The casting vessel according to claim 2, wherein the inside diameter of the second elbow adjacent the pipe piece is essentially the same as the inside diameter of the pipe piece, and decreases toward the receiving cone.

6. The casting vessel according to claim 5, wherein the second elbow comprises a piece with a receiving cone for the nozzle.

7. The casting vessel according to claim 2, wherein the pipe piece is cylindrical.

8. The casting vessel according to claim 7, wherein the second elbow comprises a piece with a receiving cone for the nozzle.

9. The casting vessel according to claim 8, wherein the wall thickness of the receiving cone increases toward a mouth of the nozzle.

10. The casting vessel according to claim 9, wherein the inside diameter of the second elbow adjacent the pipe piece is essentially the same as the inside diameter of the pipe piece, and decreases toward the receiving cone.

11. The casting vessel according to claim 2, wherein the first elbow, on a side adjacent to the pipe piece, has an inside diameter adapted to the inside diameter of the pipe piece, and, at the mouth leading to the casting chamber, has an inside diameter larger than the inside diameter adjacent to the pipe piece.

12. The casting vessel according to claim 11, wherein the second elbow comprises a piece with a receiving cone for the nozzle.

13. The casting vessel according to claim 12, wherein the wall thickness of the receiving cone increases toward a mouth of the nozzle.

14. The casting vessel according to claim 13, wherein the inside diameter of the second elbow adjacent the pipe piece is essentially the same as the inside diameter of the pipe piece, and decreases toward the receiving cone.

15. The casting vessel according to claim 14, wherein the second elbow comprises a piece with a receiving cone for the nozzle.

16. The casting vessel according to claim 2, wherein the bending radii of the first elbow are larger than bending radii of the second elbow.

17. The casting vessel according to claim 2, wherein the wall thicknesses of the second elbow are larger than wall thicknesses of the first elbow.

18. The casting vessel according to claim 17, wherein the wall thicknesses of the second elbow increase in the area of the bending radii toward the receiving cone.

19. The casting vessel according to claim 18, wherein the second elbow comprises a piece with a receiving cone for the nozzle.

20. The casting vessel according to claim 19, wherein the wall thickness of the receiving cone increases toward a mouth of the nozzle.

21. The casting vessel according to claim 1, wherein the mouth of the ascending bore leading to the casting chamber is flush with an opening in an outside cylindrical wall of the casting chamber.

* * * * *